United States Patent [19]

Miller

[11] 4,146,860

[45] Mar. 27, 1979

[54] ELECTRICAL COIL ASSEMBLY

[75] Inventor: Imrich Miller, Paterson, N.J.

[73] Assignee: Universal Manufacturing Corporation, Paterson, N.J.

[21] Appl. No.: 818,509

[22] Filed: Jul. 25, 1977

[51] Int. Cl.[2] ..... H01F 15/10

[52] U.S. Cl. ..... 336/192; 29/605

[58] Field of Search ..... 242/118.41; 29/605; 310/71; 336/192, 206, 185

[56] References Cited

U.S. PATENT DOCUMENTS

| | | | |
|---|---|---|---|
| 863,175 | 8/1907 | Heinze, Jr. | 336/185 X |
| 1,807,605 | 6/1931 | Sickles et al. | 336/206 |
| 1,888,288 | 11/1932 | Pundy et al. | 29/605 X |
| 2,159,269 | 5/1939 | Hasse | 336/192 X |
| 3,622,100 | 11/1971 | Wright | 336/192 X |
| 3,939,450 | 2/1976 | Donnelly | 336/192 X |
| 3,947,795 | 3/1976 | Donnelly et al. | 336/192 X |
| 4,039,924 | 8/1977 | Scales et al. | 336/185 |

FOREIGN PATENT DOCUMENTS

| | | | |
|---|---|---|---|
| 35018 | 12/1955 | Fed. Rep. of Germany | 336/192 |
| 2236241 | 2/1974 | Fed. Rep. of Germany | 336/192 |
| 2316719 | 10/1974 | Fed. Rep. of Germany | 336/192 |
| 644973 | 10/1950 | United Kingdom | 336/192 |

*Primary Examiner*—Thomas J. Kozma
*Attorney, Agent, or Firm*—Darby & Darby

[57] ABSTRACT

An electrical coil assembly, for transformers or the like, in which the improvment comprises a spacer, or separator board which is laid along the length of the core of the coil, said separator formed with a number of tabs for separating and holding a number of windings of the coil.

7 Claims, 3 Drawing Figures

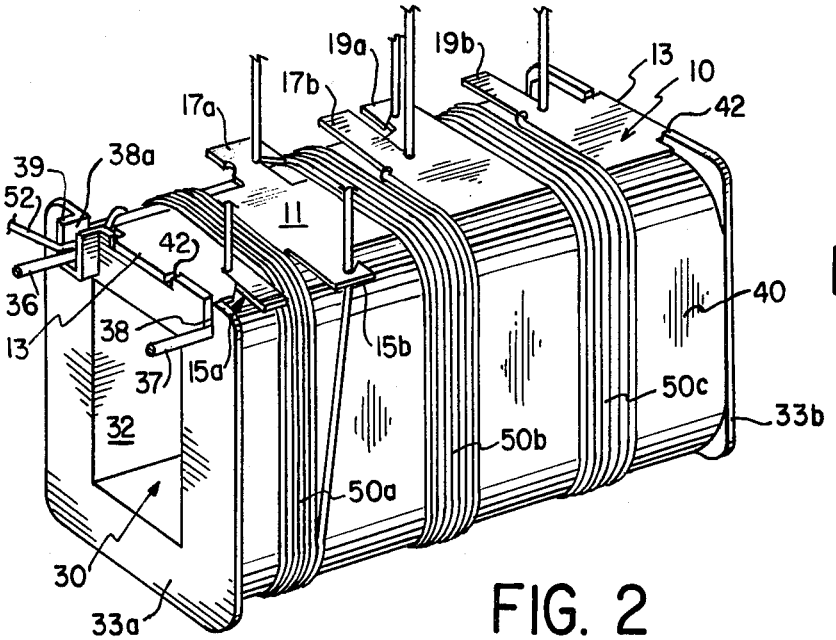
FIG. 1
FIG. 2
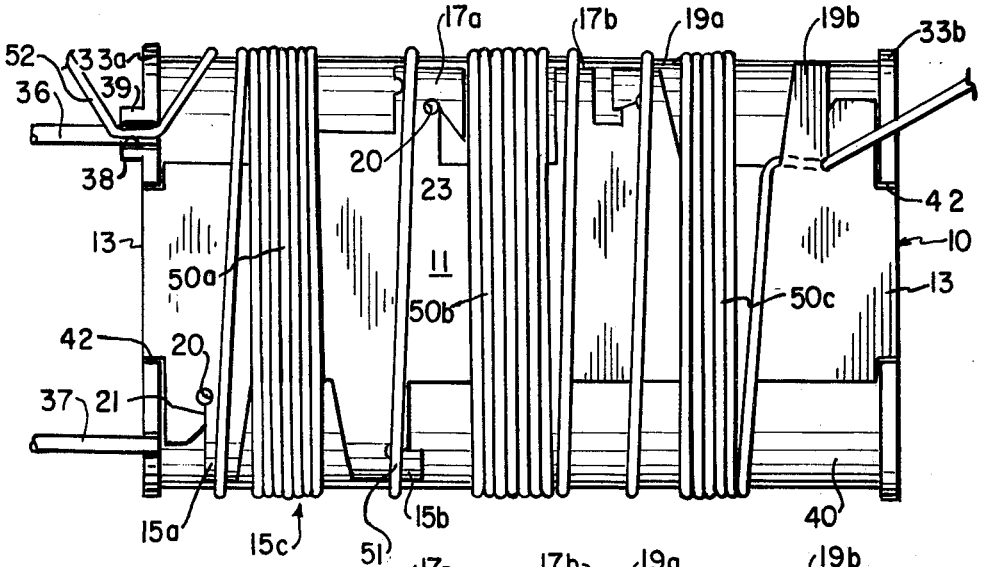
FIG. 3
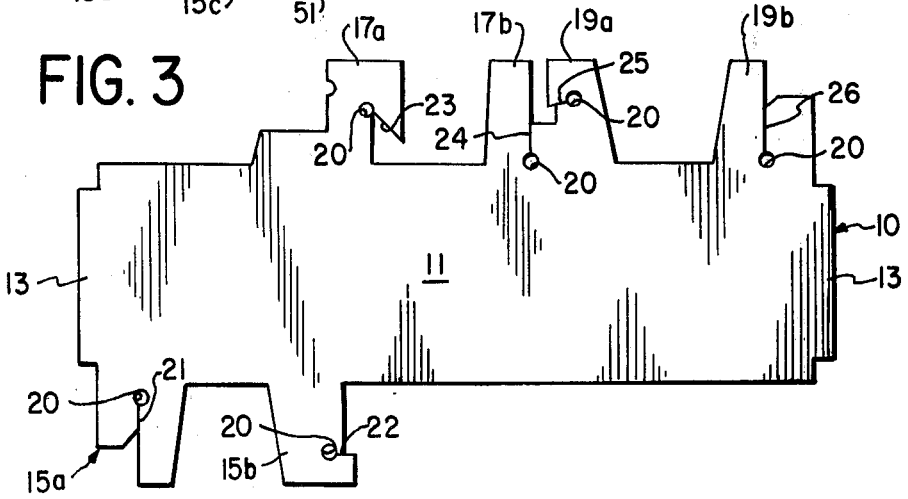

ELECTRICAL COIL ASSEMBLY

In the manufacture of various types of electrical coils or transformers, for example, ballast transformers for fluorescent lamps, a primary winding, or coil, which is to receive the input voltage is wound on a bobbin and a number of other windings, or coils, for example, for various filament, and secondary windings, are wound on top of the primary winding. This type of a winding configuration can be produced on a single bobbin or, with suitable winding machinery, on a plurality of bobbins at the same time. That is, a number of the same type of windings can be produced at the same time by a suitable multiple winding machine into which a plurality of bobbins are loaded. Transformers are also produced multiply on "sticks," that is an elongated hollow core of insulating material. In this case, a plurality of transformers are wound at the same time on a single stick and the stick is then cut to form the individual transformers.

Heretofore in the winding of transformers, the primary winding is first wound on the bobbin or the core formed by the stick. In the case of a transformer wound on a bobbin, a "precision winding" or "perfect layer" winding can be produced in which insulated wire is wound in a precise arrangement with minimum surface area contact between any two adjacent wires of the same or adjacent layers of the winding. In a "precision winding," adjacent layers of wire are not separated by any external insulating material, such as a layer of paper. In other types of windings for transformers, formed either on bobbins or on sticks, the individual layers of the primary winding are separated by one or more layers of insulating material, for example, KRAFT paper. After the primary winding has been finished, one or more layers of insulating material, such as KRAFT paper, are placed over it and then the secondary and other windings, for example, one or more secondary and one or more filament windings, are wound side by side on top of the insulating material.

In one typical prior art method of winding a transformer will additional windings on top of the primary, adhesive tape is used to separate these windings. For example, a layer of tape is laid down on top of the material insulating the primary and one of the windings is then wound thereover. The tape is then cut and fastened over the winding to keep it in place. This operation is continued for each additional winding wound on top of the primary.

While the aforesaid prior art type of winding the other windings is perfectly satisfactory, it has disadvantages in that it is rather time consuming with respect to the taping operation which is usually carried out by hand.

The present invention relates to a novel transformer and a method of winding the same in which a separator member of insulating material is used to hold the additional windings wound on top of the primary. In accordance with the invention, a separator member is provided which is laid on top of the primary winding. The separator has a number of spaced tabs on one or both sides and the additional windings are wound over the separator with a winding being located in the space between two adjacent tabs. The tabs of the separator also are resilient and will spring up if not held down. During winding of the additional coils, the takeout turns of these coils are wound over one or more of the tabs to hold them down. As the takeout turns are cut, the tabs spring up forming a fence on each side of the additional coils to hold them in place. The wires of the takeout turns of the coils are held in place in notches formed in the tabs.

It is therefore an object of the present invention to provide a novel transformer assembly and method of winding the same.

A further object is to provide a separator member for use with a transformer to hold the various additional coils.

Still an additional object is to provide a transformer and a method winding the same using a separator member so that the additional coils can be wound on top of one winding in a single step without the need for taping or use of further insulating material.

Other objects and advantages of the present invention will become more apparent upon reference to the following specification and annexed drawings, in which:

FIG. 1 is a perspective view showing a completed transformer made in accordance with the present invention;

FIG. 2 is a top view of the transformer of FIG. 1 during an intermediate stage of manufacture; and FIG. 3 is a plan view of the separator.

Referring to the drawings, FIG. 3 shows the separator 10 of the present invention. The separator 10 is made of a suitable insulating material, for example, nylon, TEFLON or other plastic, and it is preferably made by molding. The separator 10 has a central body portion 11 with notched ends 13 to fit into the bobbin, as is described below. Extending from each side of the body 11 are a plurality of tabs. The tabs are arranged in pairs spaced along the same side of the body 11. For example, on the lower side of the separator 10, as shown in FIG. 3, there is a first pair of tabs **15*a* and 15*b* and on the upper side second and third pairs of tabs 17*a*, 17*b* and 19*a* and 19*b***. Generally, there as many pairs of tabs as there are additional windings which are to be formed on the transformer. Of course, a separator can be used with fewer number of windings than there are pairs of tabs.

Each of the tabs has a respective hole 20 therein to accommodate and hold the end of a wire. Depending upon the location of the hole 20 in a given tab, an access slit is provided. For example, in tab **15*a* on the lower side of body 11, there is an access slit 21 to hole 20 which is generally transverse to the length of the body. In tab 15*b* the access slit 22 is generally perpendicular to the length of body 11. Tab 17*a* on the upper side of body 11 is formed with a pointed cutout 23 which extends into its hole 20. Tab 17*b* has a slit 24 similar to that of 21 of tab 15*a*. Tab 19*a* has an angled slit 25 to its hole 20 while tab 19*b* has a slit 26 like that of 21**.

Tabs **15*a* and 19*b* are mirror images of each other. Tabs 15*b* and 19*a*** are substantially similar. The various tabs are shaped to accomplish certain results to the end turns of the windings which they hold. This is described in greater detail below.

Referring now to FIGS. 1 and 2, the transformer includes a bobbin 30 of a suitable material, for example nylon or other suitable plastic. Bobbin 30 has a central hollow core 32 bounded by two end plates **33*a* and 33*b*. A primary winding (obscured in FIG. 1) is wound over core 32 between the two end plates 33*a* and 33*b*. The two lead wires 36, 37 of the primary winding are brought out through respective notches 38 in the first end plate 33*a*. Opening 38*a* is protected by an extending shoulder 39 formed as part of end plate 33*a***.

One or more layers of insulating material 40, for example KRAFT paper, are wound over the primary winding. The insulating layers are held by adhesive tape or any other suitable adhesive. The top of each of the end plates 33*a* and 33*b* have notches 42 to hold the separator 10 by its corresponding notched ends 13.

After the separator 10 is placed on the insulating material 40 on top of the primary, one or more additional transformer windings are wound thereover. In the preferred embodiment of the invention, the additional windings hold the separator onto the primary. If desired, adhesive tape can be placed over the separator and primary to hold the separator stationary. As illustratively shown, there are three such additional windings 50*a*, 50*b* and 50*c*. There can be any number of such windings and the separator would be configured accordingly with the appropriate number of pairs of tabs. The additional windings can be secondary windings, filament windings, etc.

Winding 50*a* is shown wound between the pair of tabs 15*a*, 15*b*; winding 50*b* between tabs 17*a*, 17*b*; and winding 50*c* between tabs 19*a*, 19*b*. The windings are wound over the separator by any conventional winding technique, usually by machine.

The additional windings are wound as a single continuous coil by a suitable winding machine. The winding takes place between the two end plates 33*a*, 33*b*. For example, as shown in FIG. 2, the end 52 of the wire forming the auxiliary windings is laid in notch 38*a* and the winding machine starts winding from left to right. One or more turns are first wound over tab 15*a*. The winding continues with the required number of turns being wound in the open space 15*c* between tabs 15*a* and 15*b* to form winding 50*a*. The winding then continues with one or more turns 51, one being shown, laid over tabs 15*b* and 17*a* to hold them down. Turn 51 is later cut at a point to form one of the takeout leads for each of windings 50*a* and 50*b*. The winding continues with the required number of turns in the space 17*c* between tabs 17*a* and 17*b* to form winding 50*b*. It then continues with one or more turns, one being shown, over tab 19*a* to hold it down and then with a number of turns in the open space 19*c* to form the additional winding 50*c*. The winding is usually finished by winding one or more turns over tab 19*b*, or, as shown, by cutting the winding and fastening it in the hole 20 in tab 19*b*. In a stick winding operation, the winding would be over tab 19*b* and would continue on to the next device. In FIG. 2, the turns are shown in the intermediate manufacturing step. During this step the turns hold the tabs down and bend them somewhat to the contour of the underlying primary winding.

The transformer is then finished by hand. Starting from left to right, turn or turns holding down tab 15*a* are unwound to the point of hole 20 in tab 15*a*. The wire is placed in this hole through slit 21 and the free end of the removed turn is laid in the notch 38*a* in end plate 33*a*. This is one of the leads for the winding 50*a*. The turn or turns 51 holding down tabs 15*b* and 17*a* are then cut at approximately the midpoint. One free end is placed in hole 20 of the tab 15*b* and the other in hole 20 of tab 17*a*. The former free end is the second takeout lead for coil 50*a*, while the latter free end is the first takeout lead for winding 50*b*. As seen, the first winding 50*a* is locked between the two tabs 15*a* and 15*b*. These tabs spring up after the turns originally holding them down are unwound.

The turn or turns 52 holding down tab 19*a* is also cut at approximately the midpoint. One free end is placed in hole 20 in tab 17*b* to form the second takeout lead for winding 50*b*. The other free end is placed in hole 20 of tab 19*a* to form the first takeout lead for winding 53. The last turn or turns over tab 19*b* are unwound and the free end placed in hole 20 of this tab to form the second takeout lead for winding 50*c*. Where there is a multiple winding of inductive devices, the wire over tab 19*b* is cut to the desired length and would be the start of the next transformer, i.e. the first takeout turn for the coil 50*a*.

As seen in FIG. 1, as the various turns which are wound over the tabs to first hold them down (as seen in FIG. 2), are cut and the tabs move up so that the entire separator is flat. Each winding 50*a*, 50*b* and 50*c* is held securely between the two tabs forming the respective open area in which it is wound. The turns of the windings do not become unwound since the ends of each winding are held where the wire passes through the hole 20 of the tab on each side of the winding. Several of the free ends are placed under a respective tab before being passed through a hole 20. The combination of the hole 20 and access slit, for example, 21, 22, provides a firm gripping action for the wire.

Where a plurality of transformers are wound at the same time, the winding machine can have either a single winding head which makes a traverse from one side to the other necessarily winding the individual transformers as described previously. The operator would then make the necessary cuts for the takeout leads and places these leads in the respective holes 20. The winding machine also can have a plurality of heads so that a plurality of transformers are wound at the same time. The operator would make the necessary cuts and bring out the takeout leads as before.

What is claimed is:

1. In combination a transformer having an elongated core over which a coil of wire is wound, an elongated separator member having a central body portion which is laid over said coil of wire and along and parallel to at least a part of the length of said core, said separator member having at least one pair of tabs extending generally transversely from said central body portion defining a space therebetween, the ends of the tabs adapted to be out of contact with the underlying coil of wire, and a winding of wire wound over said central body portion of said separator member along a part of the length of the core in said space between said at least one pair of tabs to be held between the tabs, and means on at least one of the tabs of a pair holding the free end of the wire.

2. The combination of claim 1 wherein said means for holding the free end of the wire of at least one of said tabs comprises a hold with an access slit to said hole formed in said tab, the end of the wire of the winding being held in said hole.

3. The combination of claim 1 wherein there are at least one pair of tabs extending from each side of said central body portion of said separator member.

4. The combination of claim 1 wherein said separator member formed of a relatively stiff electrical insulating material.

5. The combination of claim 1 wherein said separator member is of a flat piece of material.

6. The combination of claim 2 wherein there are two pair of tabs on the same side of said central body portion, one tab of each pair being adjacent to each other and sharing at least in part a common access slit to its hole for holding the end of the wire.

7. The combination of claim 1 wherein at least one corner of the underlying coil of wire is curved, the ends of the tabs extending above said corner.

* * * * *